United States Patent [19]

Mirowski

[11] Patent Number: 4,629,187

[45] Date of Patent: Dec. 16, 1986

[54] POOL STICK GUIDE

[76] Inventor: William A. Mirowski, 24941 Forest Dr., Lake Villa, Ill. 60046

[21] Appl. No.: 713,024

[22] Filed: Mar. 18, 1985

[51] Int. Cl.[4] ..... A63D 15/00

[52] U.S. Cl. ..... 273/24

[58] Field of Search ..... 273/24, 23; D21/232, D21/221

[56] References Cited

U.S. PATENT DOCUMENTS

| | | | |
|---|---|---|---|
| 1,105,478 | 7/1914 | Ames | 273/24 |
| 3,836,145 | 9/1974 | Frejd | 273/23 |
| 4,215,859 | 8/1980 | Charlton | 273/23 |

*Primary Examiner*—Richard C. Pinkham

*Assistant Examiner*—T. Brown

*Attorney, Agent, or Firm*—Rolland R. Hackbart

[57] ABSTRACT

A novel pool stick guide is described and illustrated that greatly enhances the shooting accuracy of a player in the game of pocket billiards. The pool stick guide includes a flat, thin guide plate having a first hole for accepting the pool stick and a second elongated hole for the player's four fingers. The guide plate is substantially rectangular having one curved short edge and one curved long edge. The first hole in the guide plate is located near the curved short side, and the second elongated hole is located between the long sides and is provided with at least four slots for receiving the fingers of a user. The guide plate is preferably comprised of a relatively hard plastic.

16 Claims, 6 Drawing Figures

POOL STICK GUIDE

BACKGROUND ART

The present invention is generally related to the game of pocket billiards and more particularly to a novel pool stick guide adapted to be used in playing pocket billiards.

Games such as pocket billiards, snooker, pool and bumper pool require a substantial amount of skill in the use and alignment of a pool stick or cue. Accuracy in shooting depends to a great degree on how well the shooter guides the pool stick. Players usually guide the pool stick by wrapping their index-finger around it or positioning it between their index-finger and their second finger. When attempting shots where the cue ball is at a distance, players often use what is called a "granny stick". A granny stick consists of a stick with a slotted guide on one end. The granny stick is held in one hand and the pool stick is rested in one of the slots of the guide. Shooting accuracy with or without the granny stick is primarily determined by how well the pool stick is positioned or guided. Accordingly, there is a need for an improved pool stick guide which accurately and reliably positions and guides the cue stick.

OBJECTS AND SUMMARY OF THE INVENTION

Accordingly, it is an object of the present invention to provide a novel pool stick guide which greatly improves shooting accuracy in games such as pocket billiards.

It is another object of the present invention to provide a novel pool stick guide for games such as pocket billiards, which enables a player to accurately and reliably position the pool stick.

Briefly described, the present invention encompasses a pool stick guide for games such as pocket billiards, which includes a guide plate having substantially rectangular top and bottom surfaces and a thin cross section. One of the short sides of the top and bottom surfaces preferably has a curved edge. The guide plate further includes a first hole disposed near the curved short side and an elongated second hole located between the long sides of the top and bottom surfaces. The first hole receives and guides the pool cue, and the players fingers are inserted into the second hole to position the guide. As a result the pool stick can be accurately and reliably positioned, thereby greatly improving shooting accuracy.

DETAILED DESCRIPTION OF THE PREFERRED EMBODIMENT

Figure 1:
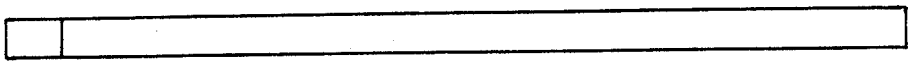
FIG. 1 is a top view of my novel pool stick guide.
Figures 3, 5, 6:
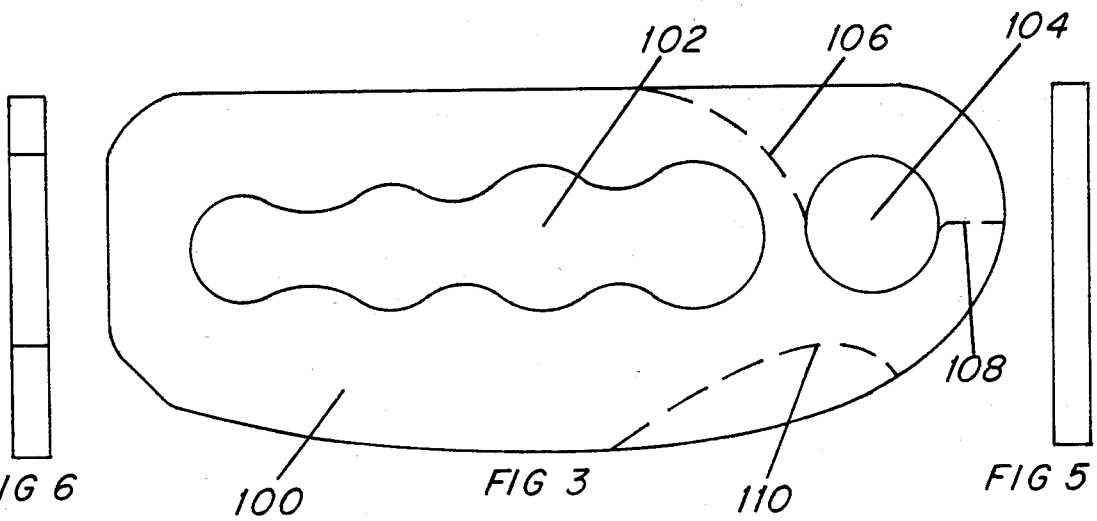
FIG. 3 is a front view of my novel pool stick guide.
FIG. 5 is a right side view of my novel pool stick guide.
FIG. 6 is a left side view of my novel pool stick guide.

In FIG. 3, there is illustrated a top view of my novel pool stick guide. The pool stick guide includes guide plate 100, a first hole 104 and a second elongated hole 102. Guide plate 100 has substantially rectangular top and bottom surfaces and a thin cross section. Guide plate 100 is comprised of flat, thin, rigid material such as plastic, wood, metal or any other suitable substance capable of withstanding the weight and movement of a pool stick. In my preferred embodiment, guide plate 100 is comprised of a hard plastic.

First hole 104 is sufficiently large to receive a pool stick or cue. Hole 104 is located near one of the curved short sides of the top surface of guide plate 100 in FIG. 3. The curved side allows guide plate 100 to be positioned many different ways, while at the same time rigidly holding the pool stick. According to another feature of my invention, hole 104 may be a slot by cutting guide plate 100 along dotted lines 106 and 108. In yet another embodiment of my pool stick guide, hole 104 may be lined with felt or any other suitable material that allows the pool stick to freely glide.

Figure 4:
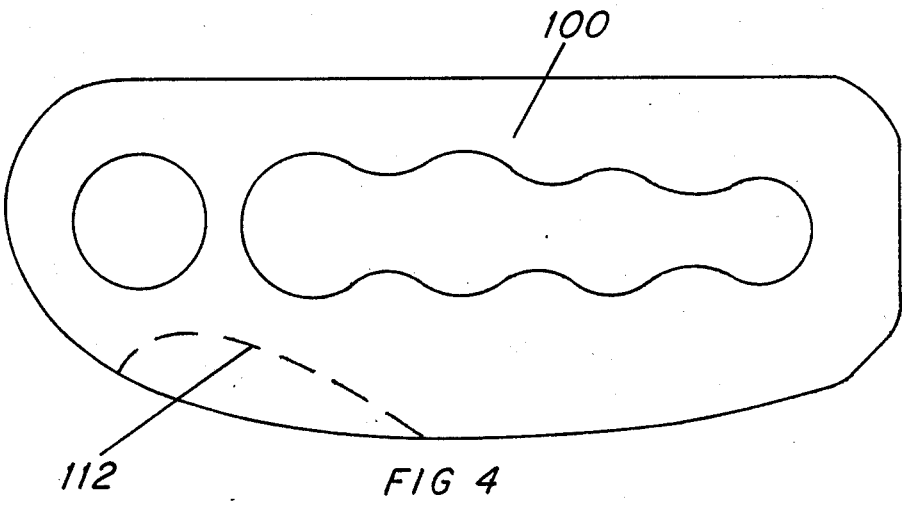
FIG. 4 is a rear view of my novel pool stick guide.
Figure 2:
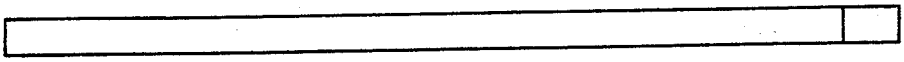
FIG. 2 is a bottom view of my novel pool stick guide.

Hole 102 is elongated and disposed between the long sides of the top and bottom surfaces of guide plate 100. Hole 102 further includes four ridges or slots and is sized to allow the player to insert four fingers past the second knuckle. Moreover, my novel pool stick guide can be used by both left and right handed players. The four ridges on hole 102 can be located on one elongated side or both elongated sides as shown in FIGS. 3 and 4.

According to yet a further feature of my invention, guide plate 100 may also include recessed areas 110 and 112 for the player's thumb. Recessed areas 110 and 112 allow the player to more rigidly position and hold my novel pool stick guide.

The elongated edges of guide plate 100 may be flat or one or both may be curved to aid in positioning the guide. In FIG. 3, guide plate 100 has a curved bottom edge and a flat top edge. Also, right side edge of guide stick 100 is preferable curved, while left side edge of guide palte 100 has rounded corners and is otherwise flat. In my preferred embodiment in FIG. 3, the radius of curvature of the right side edge is less than the radius of curvature of the bottom side edge. Also, the radius of curvature of the right side edge is different from the radius of curvature of the corners of the left side edge.

The thickness of guide plate 100 can be ascertained generally from the other views thereof in FIGS. 1, 2, 5 and 6. In an embodiment of my novel pool stick guide, the dimensions are approximately $5\frac{3}{4}$ inches long, 2 inches wide and $\frac{1}{4}$ inch thick. Hole 104 has an approximate diameter of $\frac{7}{8}$ inch, and hole 102 has an approximate length of $3\frac{7}{8}$ inches and a width of 1 inch. Hole 104 is approximately $\frac{3}{8}$ inch from right side edge in FIG. 3 and approximately $\frac{3}{8}$ inch from hole 102. As previously stated hereinabove, my novel pool stick guide is preferably comprised of a relatively hard plastic.

In summary, a novel pool stick guide has been described which enables the player to more accurately and reliably position a pool stick, thereby improving his shooting accuracy. My novel guide includes one hole for accepting the pool stick and another elongated hole for the shooter's four fingers. The shooter's thumb may rest against a recessed area to provide even greater stability. I have described herein and illustrated in the drawings a preferred embodiment of my invention. Other embodiments and variations thereof may be devised and implemented without departing from the teachings and true scope of my claimed invention.

I claim:

1. A pool stick guide adapted to be held between a player's fingers and thumb, comprising:

a guide plate having top and bottom surfaces of substantially rectangular shape, two short sides, two long sides and a thin cross section, one of the short sides of the top and bottom surfaces having a curved edge:

a first hole disposed near the curved short side of the guide plate and adapted to receive a pool stick; and an elongated second hole located between the long sides of the top and bottom surfaces of the guide plate and extending substantially from said first hole toward the side opposite said curved short side, said elongated second hole having four slots adapted to receive up to four fingers, whereby said guide may be held between the player's fingers and thumb.

2. The pool stick guide according to claim 1, wherein said first hole is lined with a predetermined material.

3. The pool stick guide according to claim 1, wherein said first hole is lined with felt.

4. The pool stick guide according to claim 1, wherein both short sides of the top and bottom surfaces have curved edges.

5. The pool stick guide according to claim 4, wherein said curved short sides have different radii of curvature.

6. The pool stick guide according to claim 1, wherein one of the long sides of the top and bottom surfaces has a curved edge.

7. The pool stick guide according to claim 6, wherein the radius of curvature of the curved short side is less than the radius of curvature of the curved long side.

8. The pool stick guide according to claim 1, wherein at least one of the elongated edges of said second hole has at least one slot.

9. A pool stick guide adapted to be held between a player's fingers and thumb, comprising:

a plastic guide plate having top and bottom surfaces of substantially rectangular shape, two short sides, two long sides and a thin cross section, one of the short sides of the top and bottom surfaces having a curved edge:

a first hole disposed near the curved short side of said guide plate and adapted to receive a pool stick;

a recessed area disposed on at least one of the top and bottom surfaces near one edge of one of the long sides of said guide plate and adapted to receive the player's thumb; and an elongated second hole located between the long sides of the top and bottom surfaces of the guide plate and extending substantially from said first hole toward the side opposite said curved short side, said elongated second hole having four slots adapted to receive up to four fingers, whereby said guide may be held between the player's fingers and thumb.

10. The pool stick guide according to claim 9, wherein said first hole is lined with a predetermined material.

11. The pool stick guide according to claim 9, wherein said first hole is lined with felt.

12. The pool stick guide according to claim 9, wherein both short sides of the top and bottom surfaces have curved edges.

13. The pool stick guide according to claim 12, wherein said curved short sides have different radii of curvature.

14. The pool stick guide according to claim 9, wherein one of the long sides of the top and bottom surfaces has a curved edge.

15. The pool stick guide according to claim 14, wherein the radius of curvature of the curved short side is less than the radius of curvature of the curved long side.

16. A pool stick guide adapted to be held between a player's fingers and thumb, comprising:

a plastic guide plate having top and bottom surfaces of substantially rectangular shape, two short sides, two long sides and a thin cross section, one of the short sides of the top and bottom surfaces having a curved edge:

a first hole disposed near the curved short side of said guide plate and adapted to receive a pool stick;

a recessed area disposed on at least one of the top and bottom surfaces near one edge of one of the long sides of said guide plate and adapted to receive the player's thumb; and an elongated second hole located between the long sides of the top and bottom surfaces of the guide plate and extending substantially from said first hole toward the side opposite said curved short side, said elongated second hole adapted to receive up to four fingers, whereby said guide may be held between the player's fingers and thumb.

* * * * *